US005934047A

United States Patent [19]

Meyers

[11] Patent Number: 5,934,047

[45] Date of Patent: Aug. 10, 1999

[54] SHRINK WRAP PACK FORMER

[75] Inventor: Kevin L. Meyers, Manheim, Pa.

[73] Assignee: NCR Corporation, Dayton, Ohio

[21] Appl. No.: 08/868,209

[22] Filed: Jun. 3, 1997

[51] Int. Cl.[6] ..... B65B 53/02; B65B 35/30

[52] U.S. Cl. ..... 53/543; 53/557

[58] Field of Search ..... 53/557, 542, 543, 53/544, 254

[56] References Cited

U.S. PATENT DOCUMENTS

| | | | |
|---|---|---|---|
| 3,914,921 | 10/1975 | Doran et al. | 53/543 |
| 4,018,031 | 4/1977 | Smaw | 53/543 |
| 4,050,217 | 9/1977 | Alduk | 53/543 |
| 4,947,605 | 8/1990 | Ramsey | 53/557 X |

OTHER PUBLICATIONS

Shanklin, "Models F–1 and F–5 Form–Fill–Seal Wrappers," 1993, five pages.

Shanklin, "Models A–27A and A–28A Automatic L–Sealers," 1995, six pages.

*Primary Examiner*—Linda Johnson

*Attorney, Agent, or Firm*—Francis L. Conte

[57] ABSTRACT

A pack former includes a staging land for initially receiving a plurality of rolls in a row. A platen adjoins the staging land, and is sized in width to engage the row in an integer multiple of the rolls to set a pack width. An actuator reciprocates the platen over the staging land to push the row onto a conveyor belt. Disposed atop the conveyor belt are front and back guides spaced laterally apart to correspond with the pack width. A stop gate is disposed atop the conveyor belt to define a packing zone for collecting a plurality of rolls being transported by the conveyor belt, with the packing zone being sized in length to set a pack depth in integer multiples of the rolls. An actuator reciprocates the gate between open and closed positions to marshal the rolls in the packing zone in a specific width and depth configuration for subsequent transport atop the conveyor belt.

20 Claims, 12 Drawing Sheets

SHRINK WRAP PACK FORMER

BACKGROUND OF THE INVENTION

The present invention relates generally to shrink wrapping, and, more specifically, to a pack former for arranging cylindrical rolls in various pack configurations.

A paper roll includes a continuous sheet of paper wrapped around a center core to form a cylinder having a centerline axis and a perimeter therearound extending in lateral width, or depth, between a pair of opposite, flat annular sides. A typical adding machine paper roll, or add roll, is an example of a paper roll which is conventionally manufactured and requires suitable packaging for distribution to subsequent purchasers.

The rolls are typically formed or configured in single layer matrix packs having an integer width and an integer depth. The pack depth is typically defined by the number of rolls coaxially aligned with their flat sides abutting together. The pack width is correspondingly defined by the number of rolls abutting together at their perimeters. The pack width defines a row of rolls laterally abutting at their perimeters, with the pack depth defining a column of rolls coaxially abutting at their flat sides.

The pack configuration is typically defined by the number of rows and columns in integer width and depth. Exemplary pack configurations include 1×5, 5×2, 5×4, etc., which are merely representative of the numerous pack configurations which may be used in commerce.

A pack forming machine is typically used for arranging individual rolls in suitable packs which are then bound together using a conventional wrapping, such as a shrink wrap applied by a conventional shrink wrapping machine. The pack former and shrink wrapper are typically found in tandem with suitable conveyor belts transporting the rolls in the pack former for forming suitable packs, and then in turn transporting the packs through the shrink wrapper which applies the shrink wrap thereto for bounding together the individual packs in a stable, flat configuration.

One type of prior art pack former includes a plurality of metal lane dividers disposed atop a conveyor belt. A cue of individual paper rolls is initially coaxially aligned in the depth direction, with a suitable pusher plate sequentially removing groups of the rolls in columns of preselected depth atop a staging area until a suitable number of columns are collected in rows, and then transported together into one or more of the divided lanes atop the conveyor belt. At the end of the conveyor belt, a pivoting gate temporarily blocks passage of the rolls from the lanes until a sufficient depth thereof is obtained. A clamp is then deployed atop a forward row of the rolls for allowing the gate to be opened to discharge a specific pack configuration in an aft direction for subsequent wrapping in a conventional shrink wrapper. The gate is then closed, and the clamp released for collecting another pack behind the gate.

In view of the relative complexity of this conventional lane pack former, it is subject to undesirable lane jamming and speed limitation, and difficulty of setup for reconfiguring the packs.

Accordingly, improvements in reconfiguration setup, reliability, speed, and simplicity of structure and function are desired in a pack former.

SUMMARY OF THE INVENTION

A pack former includes a staging land for initially receiving a plurality of rolls in a row. A platen adjoins the staging land, and is sized in width to engage the row in an integer multiple of the rolls to set a pack width. An actuator reciprocates the platen over the staging land to push the row onto a conveyor belt. Disposed atop the conveyor belt are front and back guides spaced laterally apart to correspond with the pack width. A stop gate is disposed atop the conveyor belt to define a packing zone for collecting a plurality of rolls being transported by the conveyor belt, with the packing zone being sized in length to set a pack depth in integer multiples of the rolls. An actuator reciprocates the gate between open and closed positions to marshal the rolls in the packing zone in a specific width and depth configuration for subsequent transport atop the conveyor belt.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
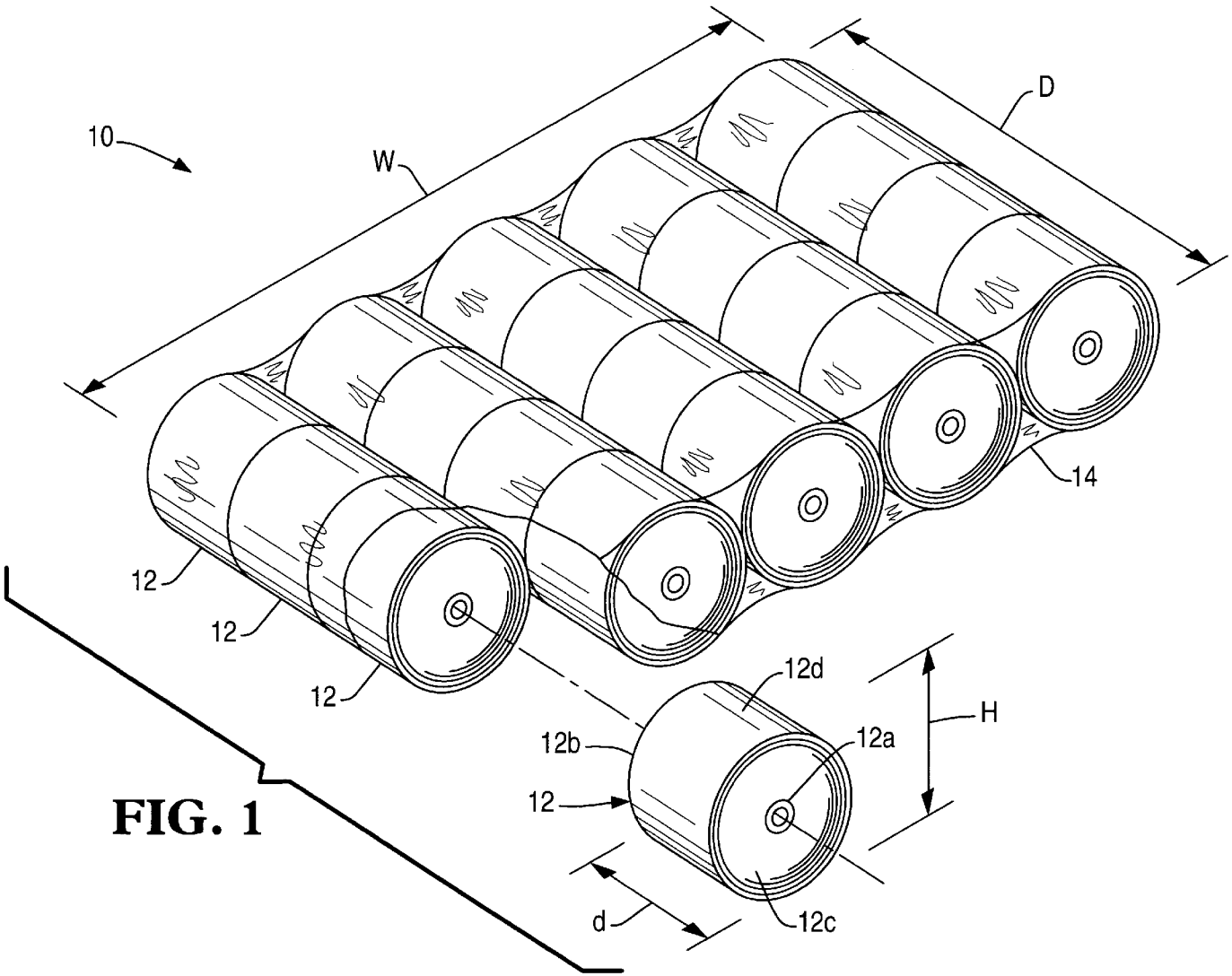
FIG. 1 is a pack of paper rolls in an exemplary configuration of width and depth bound together in a shrink wrap.

Illustrated in FIG. 1 is an exemplary pack 10 of individual paper rolls 12 in an exemplary single layer configuration having a width W and depth D. The rolls 12 are bound together in the pack 10 using conventional shrink wrap 14.

The individual rolls 12 may have any suitable configuration and typically include a continuous sheet of paper, such as for an adding machine, wound about a central core 12*a*. The roll 12 has two flat circular sides 12*b,c* spaced apart along a centerline axis at a suitable roll width or depth d. The roll 12 has a cylindrical perimeter 12*d* having an outer diameter or height H.

Figure 2:
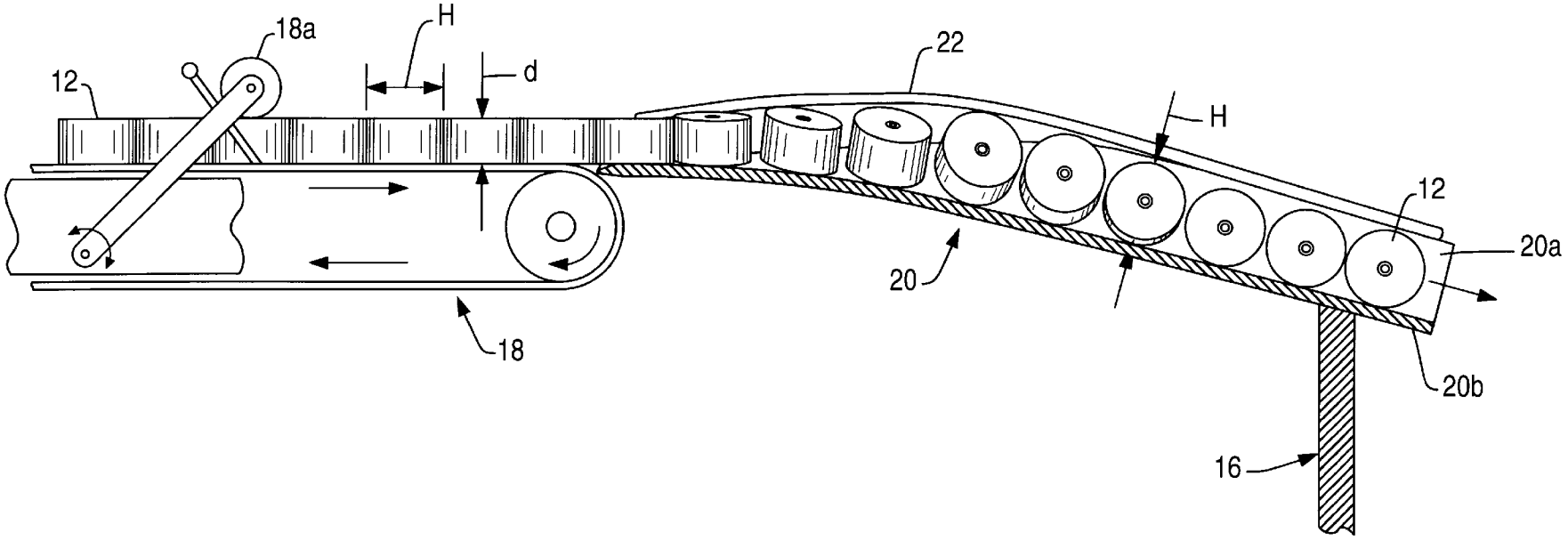
FIG. 2 is an elevational, partly sectional view of a feed conveyor for feeding a linear sequence of rolls to a feed chute of a pack former in accordance with an exemplary embodiment of the present invention.
Figure 3:
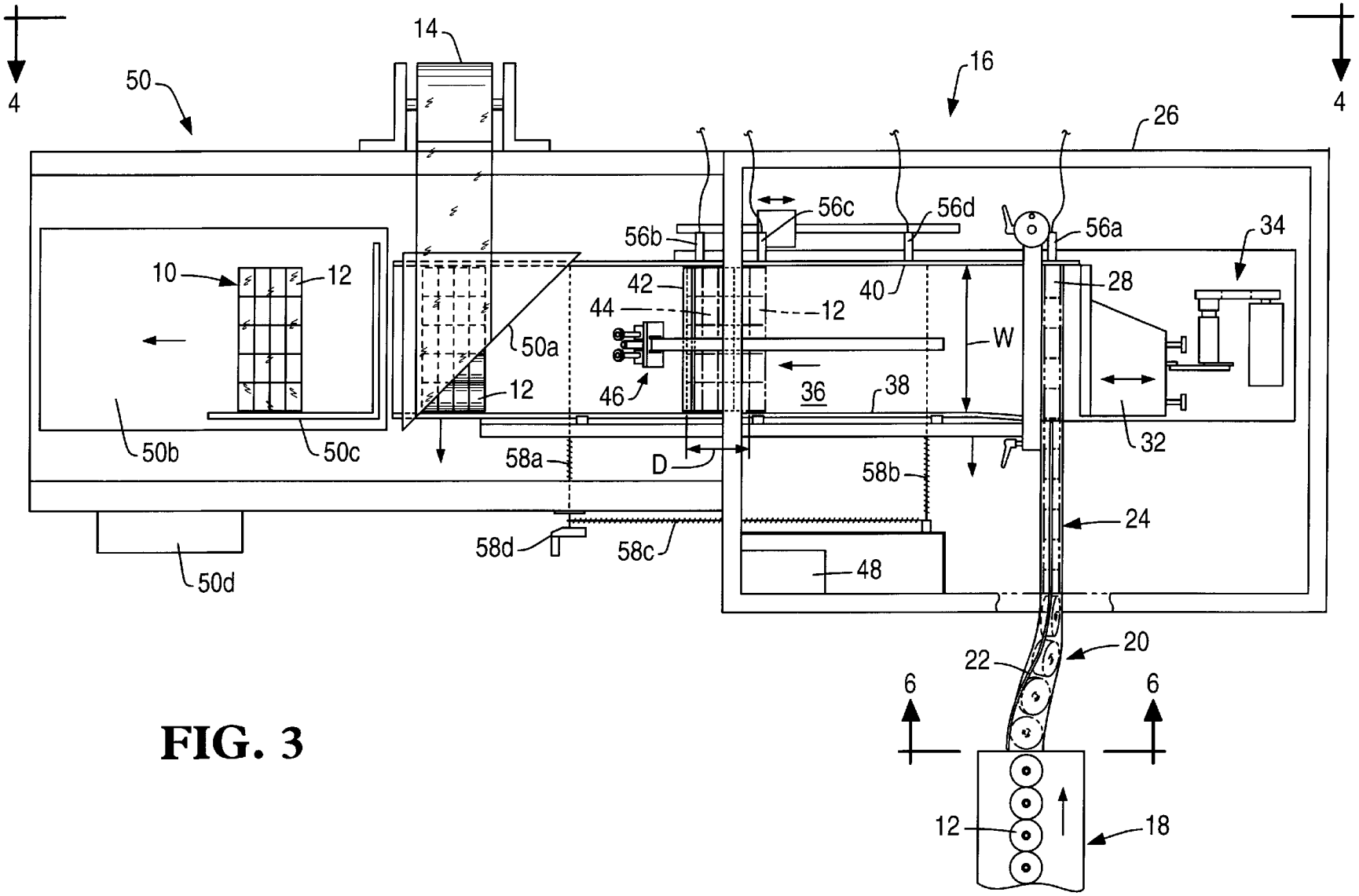
FIG. 3 is a plan view of a pack former in an exemplary embodiment for receiving the rolls from the feed conveyor illustrated in FIG. 2.
Figure 4:
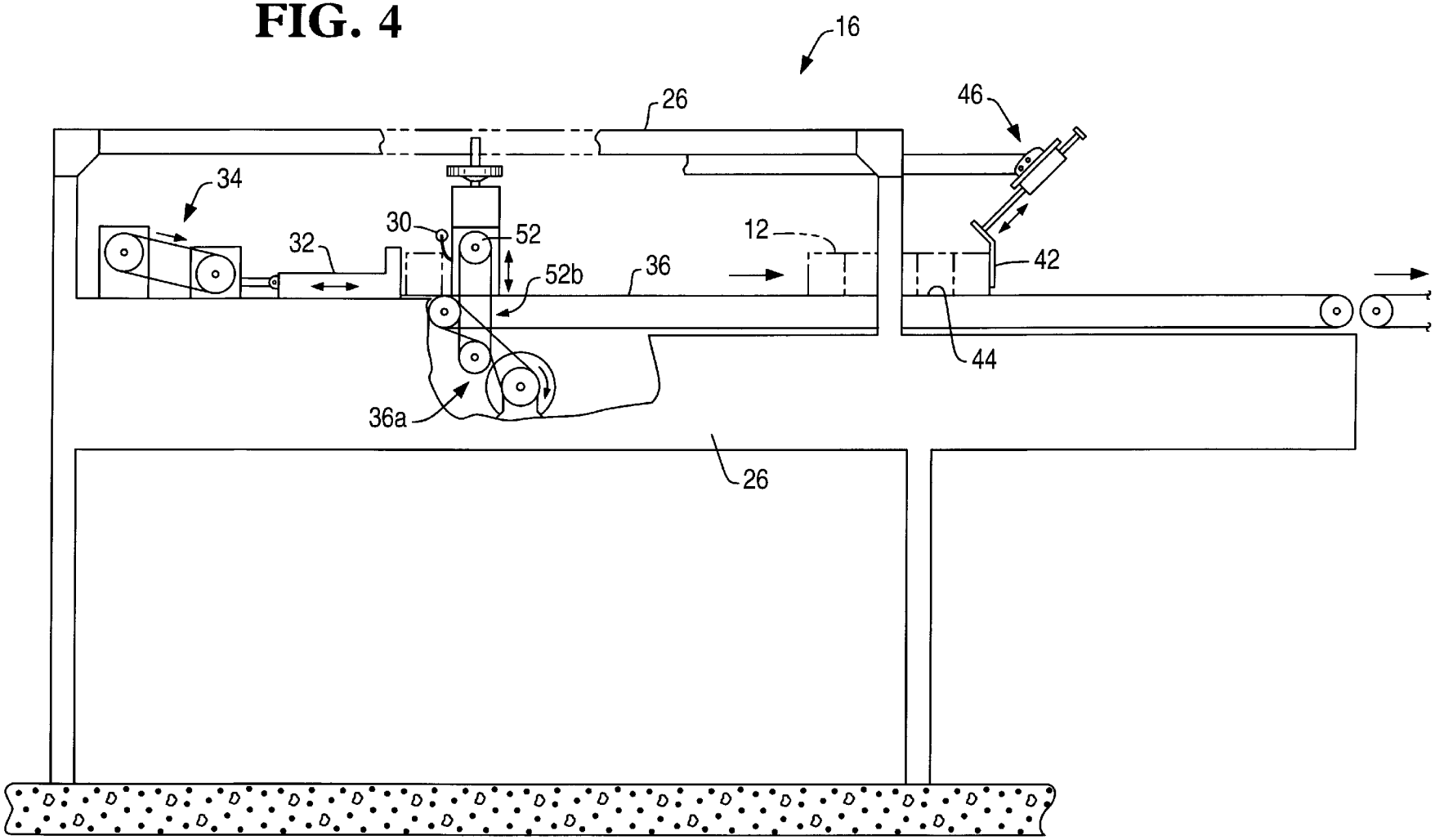
FIG. 4 is a partly sectional, elevational view of the pack former illustrated in FIG. 3 and taken along line 4—4.

The individual roll 12 has two basic orientations, one being horizontal with the core 12*a* extending horizontally for resting the roll 12 on its perimeter 12*d,* with the sides 12*b,c* extending vertically as illustrated in FIG. 1. The second orientation is vertical with the core 12*a* extending vertically for resting the roll on one of its two flat sides 12*b,c* as shown in the lefthand portion of FIG. 2. FIGS. 3 and 4 illustrate a pack apparatus or former 16 in accordance with an exemplary embodiment of the present invention for grouping or configuring the plurality of the rolls 12 in packs 10 which may be processed in batch runs of varying width W and depth D configurations. As As initially shown in FIGS. 2 and 3, a conventional feed conveyor 18 transports in single line a plurality of the rolls 12, initially in vertical orientation, to the pack former 16. The feed conveyor 18 is preferably a conventional pounder conveyor such as Model No. 517S manufactured by the Gerhart Company which is specifically configured to pound the individual rolls 12 on their sides to ensure alignment of the cores thereof with the surrounding paper for the purpose of meeting adding machine and point-of-sale register specifications relating to width tolerances, and for reducing the likelihood of snagging or jamming during travel through the pack former. And, a suitable rider-roller 18*a* is positioned atop the line of rolls 12 to increase friction driving force on the feed conveyor 18.

The pack former 16 preferably includes a spiral infeed chute 20 disposed adjacent to the feed conveyor 18 for initially receiving the rolls 12 in sequence and rotating or changing the orientation of the rolls 12 from vertical to horizontal for subsequent handling in the former 16. The feed chute 20 is illustrated in more particularity in FIGS. 2, 5 and 6 and preferably includes first and second walls 20*a,b* having an open L-shaped configuration which spirals clockwise in FIG. 6.

In this way, the individual rolls 12 enter the chute 20 in their vertical orientation and are rotated to the horizontal orientation at the discharge end of the chute 20 to feed horizontal rolls 12 into the pack former. As the rolls 12 are pushed through the chute 20 by the feed conveyor 18, the sides thereof initially slide along the first wall 20*a* initially horizontally as its spirals clockwise. The second wall 20*b* also spirals clockwise from vertical to horizontal so that the perimeters of the rolls rest atop the horizontal portion of the second wall 20*b* at its discharge end.

Since the open feed chute 20 may receive rolls 12 having different diameters or height H and different widths or depths d in different batches, a curved guide bar 22 in the form of a rod is fixedly joined atop the feed chute 20, and is suitably adjustable in height for guiding or engaging the perimeters of the rolls 12 as they travel through the feed chute 20. The guide bar 22 correspondingly spirals relative to the feed chute 20 for allowing unobstructed travel of the rolls 12 therethrough without lateral ejection therefrom.

Figure 5:
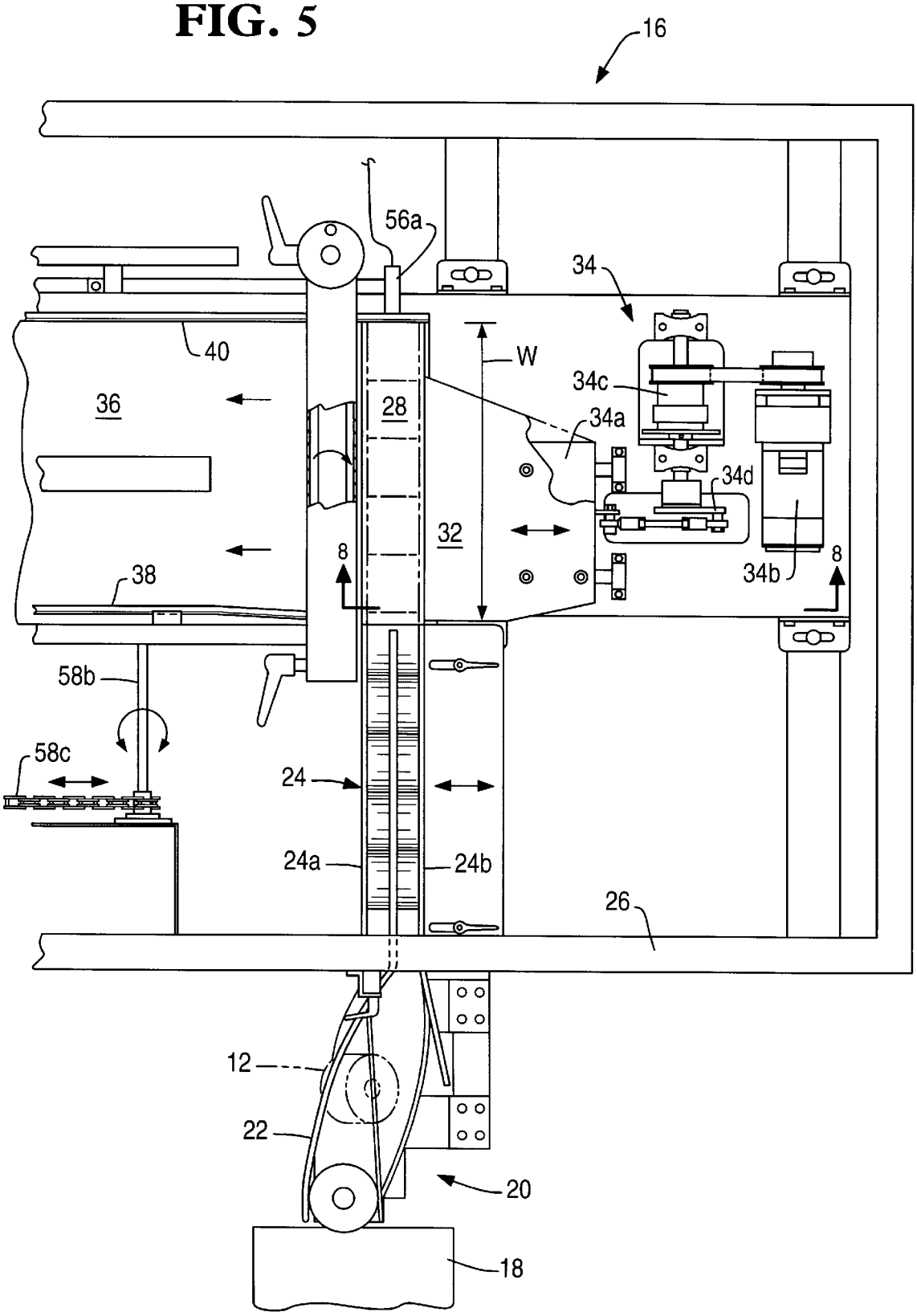
FIG. 5 is an enlarged plan view of the righthand portion of the pack former of FIG. 3.
Figure 6:
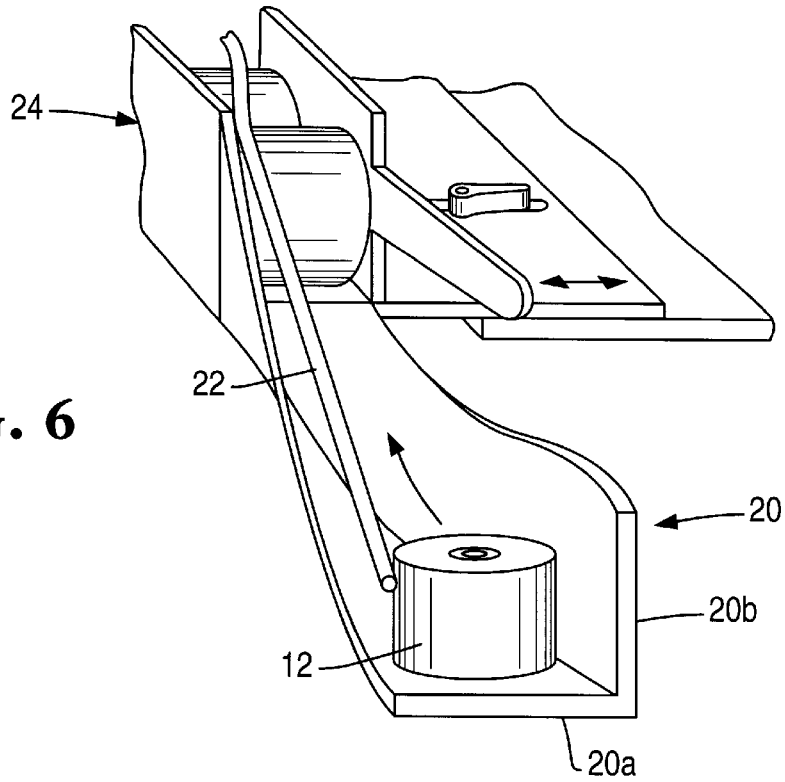
FIG. 6 is a perspective view of the feed chute illustrated in FIG. 3 and taken generally along line 6—6.

As shown most clearly in FIG. 5, a generally U-shaped staging chute 24 is disposed in line with the feed chute 20 for receiving therefrom the reoriented rolls 12 in their horizontal orientations. The former 16 includes a suitable multi-beam main frame 26 which is stationary and suitably mounted to a floor. The various components of the former 16 including the feed and staging chutes 20, 24 are suitably attached thereto. The staging chute 24 illustrated in FIG. 5 provides a suitable length in which the rolls 12 are pushed by the feed conveyor 18 in a single line cue prior to undergoing configuration in variously sized packs. In the preferred embodiment illustrated in FIG. 5, the staging chute 24 includes first and second sidewalls 24*a,b* which are suitably adjustable in spacing or width for accommodating different width or depth d rolls 12. For a specific batch run of the former 16, one size of the rolls 12 is used, with the guide bar 22 extending also above the staging chute 24 and being adjusted for constraining transport of the rolls 12 in single line fashion.

As shown in FIG. 5, a stationary staging land 28 is suitably joined to the frame 26 and extends to the staging chute 24 for receiving the rolls 12 sequentially in line therefrom. In this way, the chute conveyor 18 pushes in sequence the rolls 12 along the feed and staging chutes 20, 24 for subsequent resting atop the staging land 28. In the preferred embodiment illustrated in FIG. 5, and in more detail in FIG. 7, the rolls 12 are staged atop the land 28 in their horizontal orientation. The second sidewall 24*b* of the staging chute 24 is preferably L-shaped for being adjustably mounted to the frame 26. This sidewall preferably includes an attached alignment bar 24*c* extending over the forward side of the staging land 28 to guide the rolls 12 into position thereon. The guide bar 24*c* is sufficiently thin to simply contact the lower portions of the rolls 12 at their forward sides to cue them in line atop the staging land 28.

Figure 7:
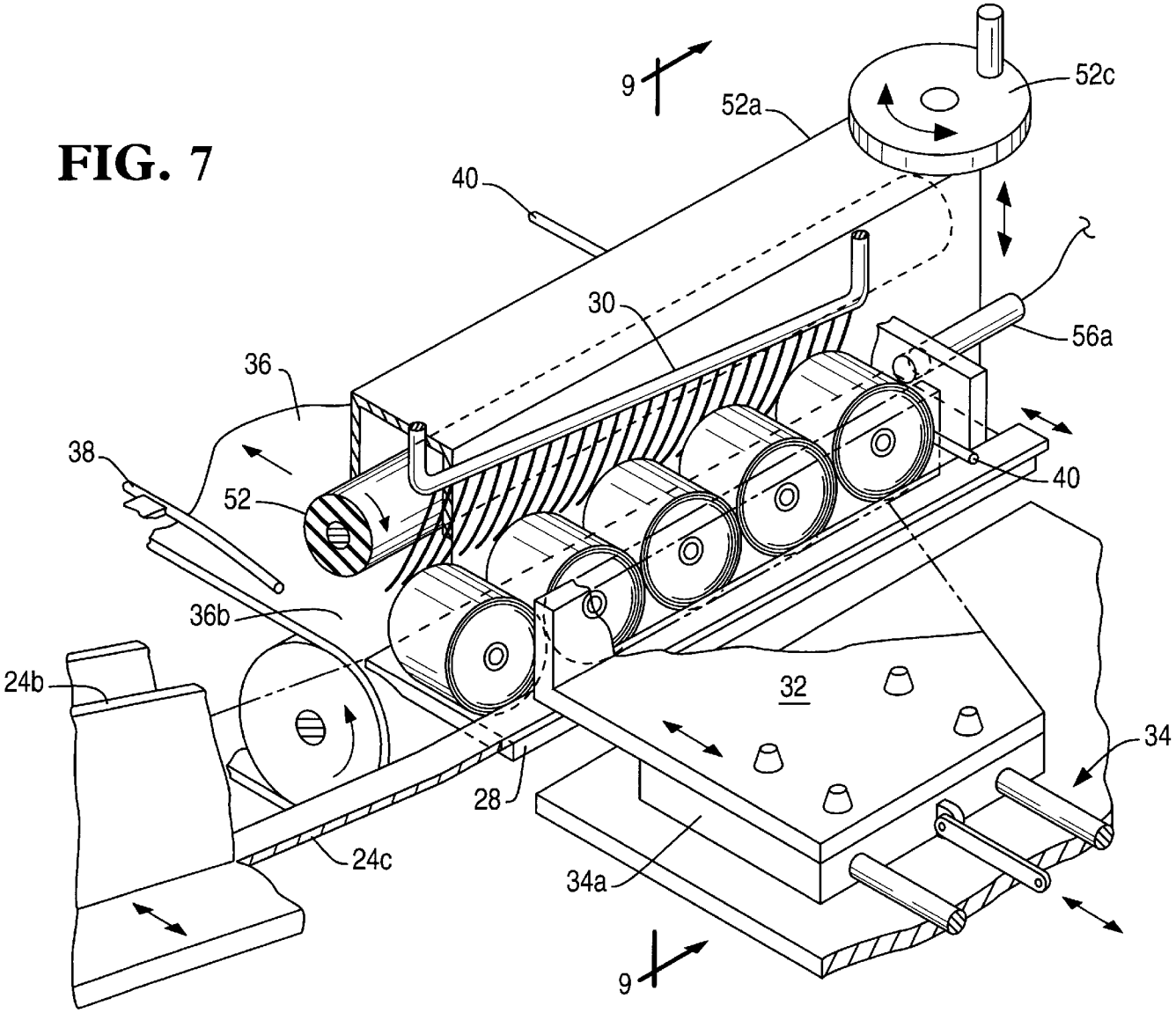
FIG. 7 is a perspective, partly sectional view of a staging region of the pack former illustrated in FIG. 5.

As shown in FIG. 7, a stationary brush 30 in broom form is disposed above the staging land 28 for resiliently engaging the rolls 12 upon receipt thereof atop the staging land 28. The brush 30 has resilient whiskers, and is suitably suspended from an upper portion of the flame 26.

As shown in FIGS. 5 and 7, a removable platen 32, also referred to as a push plate, adjoins the staging land 28. The rolls 12 are laterally trapped between the brush 30 and the guide bar 24*c* adjacent the platen 32 in single file row. The platen 32 is sized in width to engage the row in an integer multiple of the rolls 12 to define or set the pack width W. In the exemplary embodiment illustrated in FIGS. 5 and 7, the platen 32 is sized for the pack width W of five (5×) rolls 12. The platen 32 may be otherwise sized in width from as little as one roll 12 if desired, to as many as desired within a practical width of the pack former 16 itself As initially shown in FIG. 5, suitable means in the form of a platen actuator 34 are provided for reciprocating the platen 32 over the staging land 28 to simultaneously push the rolls 12 in a corresponding row onto an infeed or feed conveyor belt 36. The conveyor belt 36 may have any conventional form including a subframe suitably mounted to the main frame 16, and rollers over which the continuous loop belt 36 is rotated, and a suitable belt-driven motor drive 36*a* as illustrated schematically in FIG. 4. The feed conveyor belt 36 provides a convenient manner for transporting the row of rolls as illustrated in FIG. 7 as they are pushed thereon by the platen 32.

As shown in FIGS. 5 and 7, a preferably stationary front or first guide 38 is disposed above or atop and parallel to the conveyor belt 36 and extends aft from the staging land 28. As shown in FIG. 7, the conveyor belt 36 includes a leading edge 36*b* at a forwardmost roller thereof upon which the row of rolls 12 is firstly received for subsequent transport in an aft direction. The upper portion of the conveyor belt 36 travels away from the staging land 28 in a downbelt or aft direction toward the trailing edge roller of the conveyor belt 36. The forward direction relative to the travel of the upper conveying surface of the conveyor belt 36 is the upbelt direction toward the staging land 28.

Referring again to FIGS. 5 and 7, a second or back guide 40 is disposed atop or above the conveyor belt 36, and extends from the staging land 28 and is laterally spaced from the front guide 38 to correspond with the pack width W. In the exemplary embodiment illustrated in FIGS. 5 and 7, the front guide 38 is suspended from the frame 16 and is stationary atop the conveyor belt 36, whereas the back guide 40 is suitably joined to the subframe of the conveyor belt 36 and is movable therewith as described in more detail hereinbelow.

As shown in FIG. 7, a row of rolls 12 is initially laterally staged between the brush 30 and platen 32 on its sides, and at its forward end by the back guide 40. The platen actuator 34 is effective to reciprocate the platen 32 for pushing a single row of the rolls 12 atop the conveyor belt 36 which transports the row aft, and confined laterally between the front and back guides 38,40.

As shown in FIGS. 3 and 4, a preferably normally closed stop gate 42 is disposed above or atop the conveyor belt 36, and is spaced aft from the belt leading edge 36*b* to define a packing zone 44 for collecting a plurality of the rolls or rows being transported by the conveyor belt 36 from the staging land 28. The packing zone 44 is preferably sized in length to set or define the pack depth D in integer multiples of the rows or rolls 12.

As shown in FIG. 4, suitable means are provided in the form of a gate actuator 46 for reciprocating the stop gate 42 between open and closed positions.

As shown in FIG. 3, a controller 48 is operatively joined to the platen and gate actuators 34,46 to periodically close the gate 42, as well as periodically deploying or pushing the platen 32 to marshal one or more rows of the rolls 12 in the packing zone 44 to define a specific configuration of the width W and depth D of the pack 10 in a single flat plane. The pack width W is conveniently set by the corresponding width of the specific platen 32, and spacing between the front and back guides 38, 40, with individual rows of the rolls 12 collecting behind the stop gate 42. Once a suitable number of the rows is marshalled in the packing zone 44 to define a specific depth D of the pack 10, the stop gate 42 may be opened for releasing the pack 10 for transport by the conveyor belt 36 in the aft direction. The pack former 16 illustrated in FIG. 3 is preferably used in combination with a shrink wrapper or apparatus 50 which adjoins the conveyor belt 36 aft of the stop gate 42 for receiving the packs 10 in sequence to shrink wrap the wrapping 14 thereover.

As shown in FIG. 3, the shrink wrapper 50 may take any conventional form such as a Model A-27A Automatic L-Sealer commercially available from the Shanklin Corporation of Ayer, Mass. In accordance with the present invention, the conveyor belt of the pack former 16 is a modified and extended version of the conventional conveyor belt found in the shrink wrapper 50. The conveyor belt 36 as described above extends forwardly into the pack former 16 up to the staging land 28, and extends suitably aft from the stop gate 42 for allowing on-the-run conventional shrink wrapping of the packs 10 as they are formed in sequence. The shrink wrap 14 is suitably stored on a roll mounted to the shrink wrapper 50 and is unwound over a conventional turn bar 50*a* which bridges the trailing edge portion of the conveyor belt 36.

The turn bar 50*a* is conventionally used for wrapping the pack of rolls 12, which are then transported to a second conveyor belt 50*b* in the wrapper 50 above which are found conventional seal bars 50*c* to seal the shrink wrap 14 over the pack 10 for completing the packaging thereof. The shrink wrapper 50 includes its own controller 50*d* which controls its own operations when receiving the packs 10 from the pack former 16.

Figure 8:
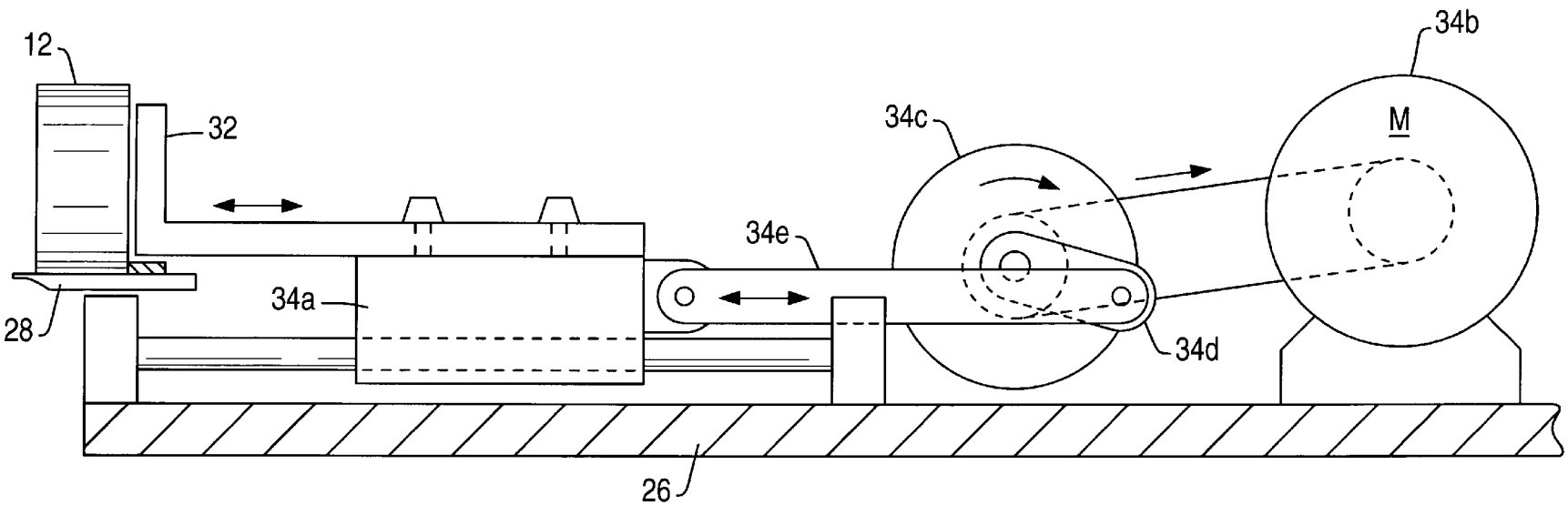
FIG. 8 is an elevational, partly sectional view of a platen and actuator shown in FIG. 5 and taken along line 8—8.

A significant component of the present invention is the use of interchangeable platens 32 as illustrated in FIGS. 5 and 8 for use in varying the pack width W. The platen 32 itself may have any suitable form such as a simple L-shaped plate having a suitable width to match the desired corresponding integer width W of the resulting pack 10 of one or more rolls 12.

The platen actuator 34 preferably includes a carriage 34*a* in the form of a plate suitably mounted in a pair of stationary cylindrical rails joined to the frame 26 for transporting the platen 32 thereatop in reciprocating movement. The platen 32 may simply be removably mounted to the carriage 34*a* using conventional fasteners such as bolts. This allows ready interchangeability of platens 32 having different widths to vary the pack widths W.

The platen actuator 34 illustrated in FIGS. 5 and 8 includes a suitable drive operatively joined to the carriage 34*a* and the controller 48 to periodically reciprocate the platen 32 to push a corresponding plurality of the rows in sequence from the staging land 28 onto the conveyor belt 36. As shown in FIG. 5, the platen drive preferably includes a drive motor 34*b* operatively joined by a drive belt to a conventional wrap spring clutch 34*c*. The clutch 34*c* is operatively joined to a crank arm 34*d*, shown more clearly in FIG. 8, with the crank arm 34*d* being in turn joined to a link arm 34*e* which is suitably joined to the aft end of the carriage 34*a*.

The drive motor 34*b* preferably operates continuously for driving the clutch 34*c*. Upon a suitable signal form the controller 48, the clutch 34*c* is actuated to engage and rotate the crank arm 34*d* in one complete rotation, to in turn reciprocate the link arm 34*e* and the carriage 34*a* attached thereto for deploying and retracting the platen 32. Upon deployment of the platen 32, a single row of the rolls 12 is pushed form the staging land 28 onto the conveyor belt 36 for transport. Upon retraction of the platen 32, an additional row of the rolls 12 is formed atop the staging land 28 as the feed conveyor 18 pushes the rolls 12 along the feed and staging chutes 20, 24. The process is repeated as each row of the rolls 12 is completed atop the staging land 28.

Figure 9:
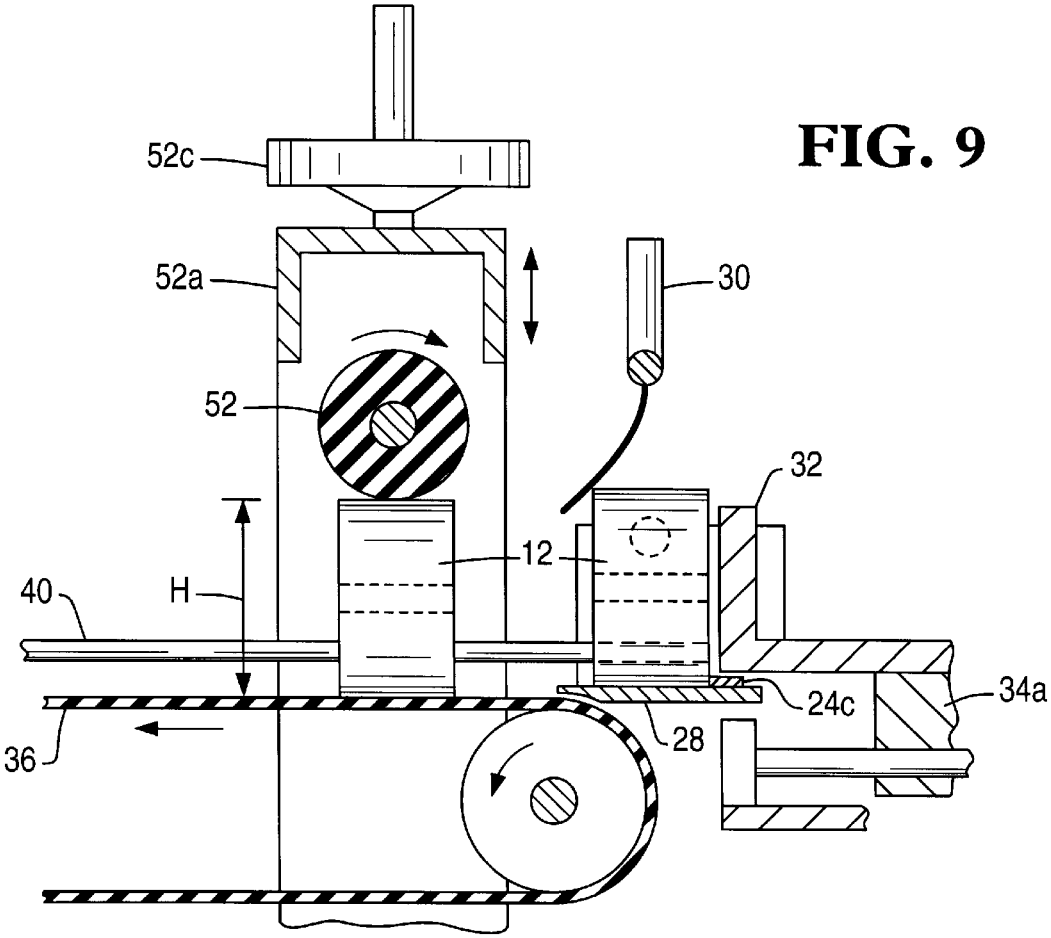
FIG. 9 is an elevational, partly sectional view of a pull roller adjoining the staging land illustrated in FIG. 7 and taken generally along line 9—9.

As shown in FIGS. 7 and 9, the row of rolls 12 is pushed by the platen 32 from a standing, stationary position atop the staging land 28 onto the moving conveyor belt 36. In order to prevent undesirable tipping of the rolls 12 as they are pushed atop the conveyor belt 36, the pack former 16 preferably also includes a pull roller 52 spaced atop the belt 36 adjacent the staging land 28 to match the height H of the rolls 12 initially awaiting atop the staging land 28. The pull roller 52 is mounted in its own subframe 52*a* which in turn is preferably mounted to the subframe of the conveyor belt 36 which is mounted to the main frame 16.

Suitable means in the form of a roller drive 52*b*, as shown in FIG. 4, are provided for rotating the pull roller 52 at a surface speed substantially equal to the surface speed of the conveyor belt 36 in the same downbelt direction, so that the pull roller 52 sequentially captures or clamps from the top the individual rows of rolls 12 deployed from the staging land 28. As shown in FIG. 9, the rotating pull roller 52 ensures that the individual rolls 12 are accelerated to speed atop the conveyor belt 36 substantially equally at the top and bottom thereof for preventing tipping thereof during operation.

The pull roller 52 may be suitably joined to its subframe 52*a* for allowing its height above the conveyor belt 36 to be varied. This may be accomplished using conventional threaded rods joining the stationary supporting shaft of the roller to the subframe 52*a* so that manual turning of a simple handle or wheel 52*c* correspondingly raises and lowers the pull roller 52 atop the conveyor belt 36. As shown in FIG. 4, the roller drive 52*b* may be suitably joined to the belt drive 36*a* using another drive belt therebetween for being rotated simultaneously by the common motor drive 36*a*.

Figure 10:
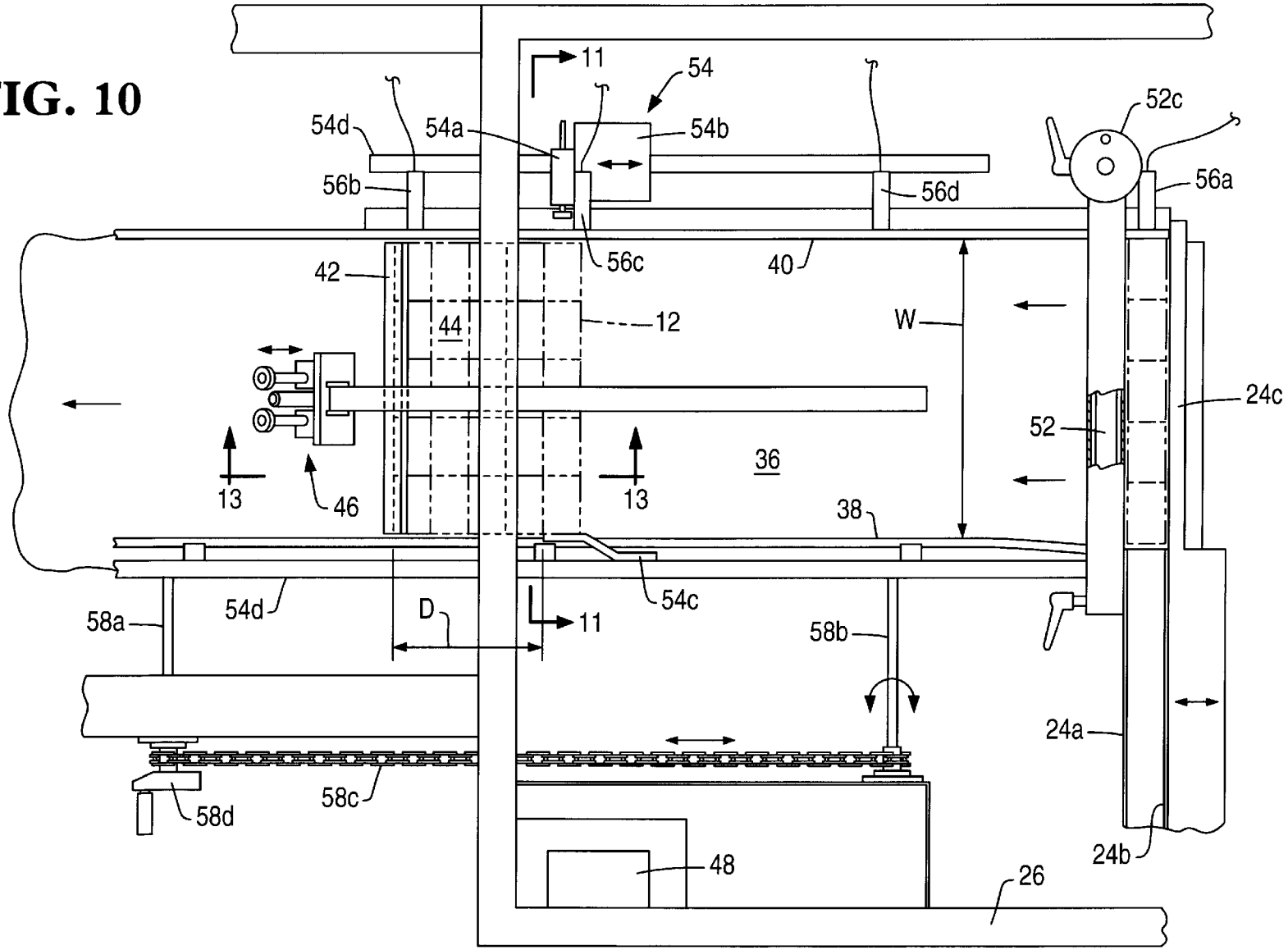
FIG. 10 is an enlarged plan view of the lefthand portion of the pack former of FIG. 3.
Figure 11:
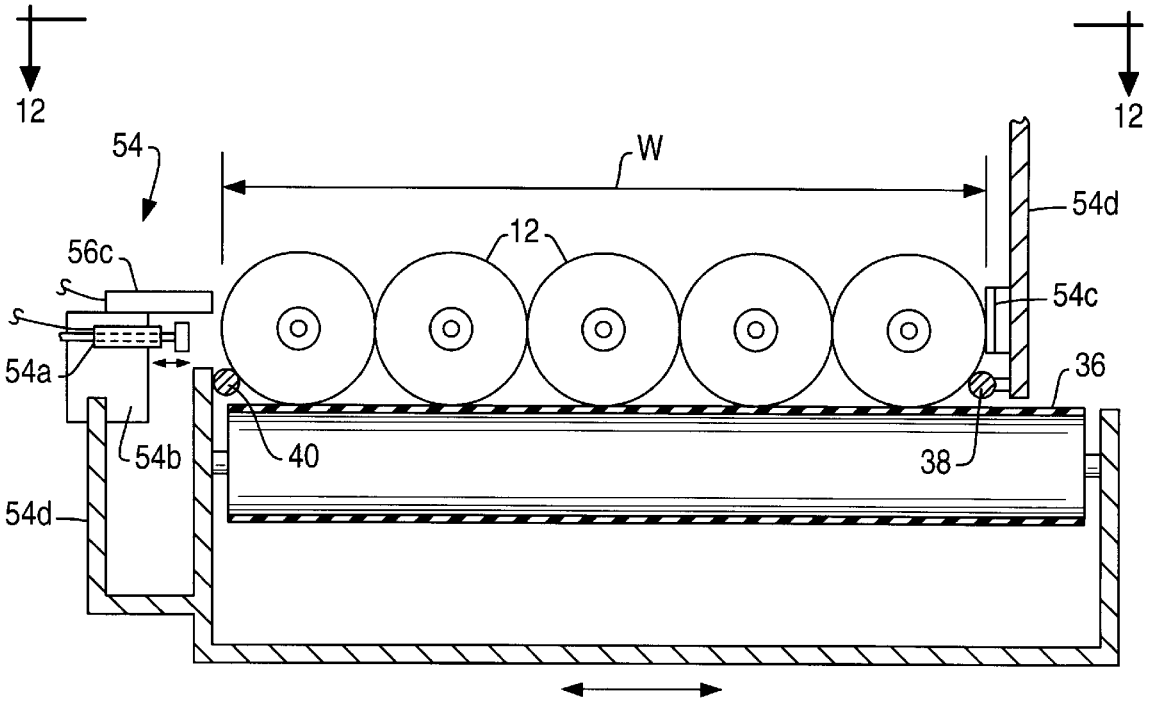
FIG. 11 is an elevational, partly sectional view through a retaining region of the conveyor belt illustrated in FIG. 10 and taken generally along line 11—11.
Figure 12:
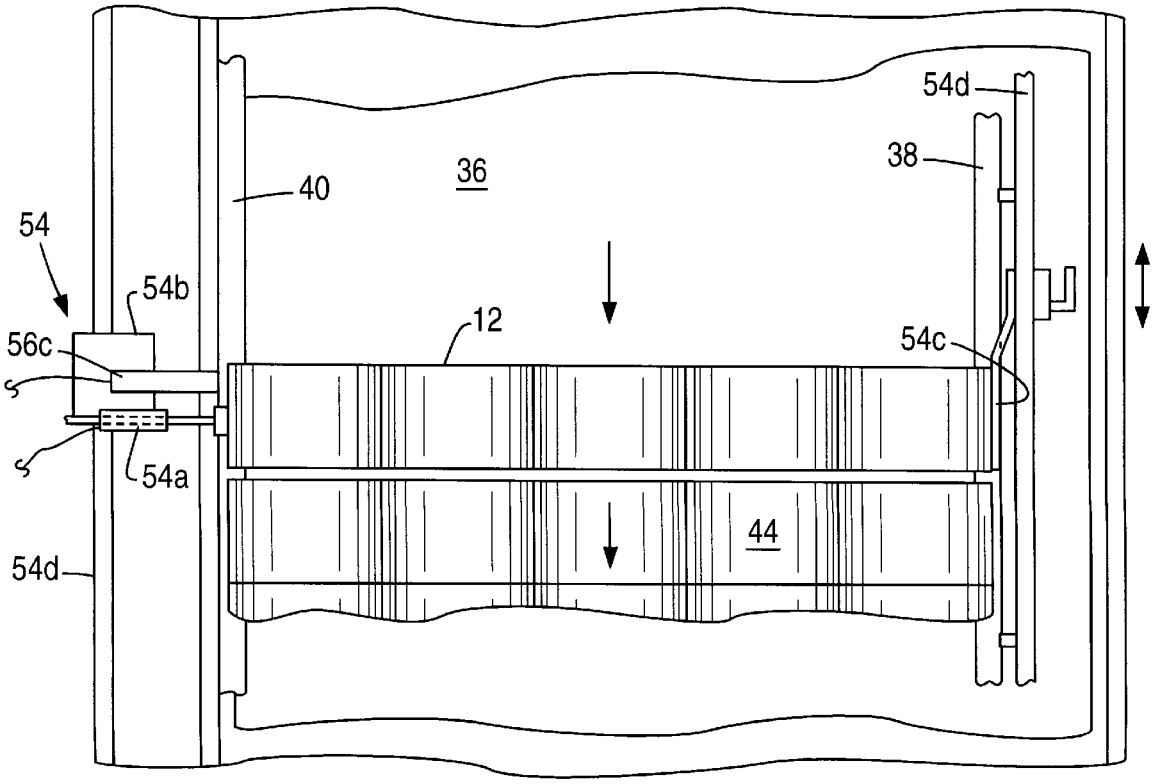
FIG. 12 is a plan view of the retaining region illustrated in FIG. 11 and taken generally along line 12—12.

As shown in FIGS. 10–12, the pack former 16 preferably also includes means in the form of a retainer or clamp 54 disposed at a leading edge of the packing zone 44 for periodically retaining or clamping a dwell one of the rows of rolls 12 to allow the stop gate 42 to open and the pack 10 to leave the packing zone 44 upon the conveyor belt 36, without excess rows. As shown in FIG. 10, the packing zone 44 is configured for marshalling a pack of the rolls 12 in a pack width by depth W×D, of 5×4 rolls for example. The twenty rolls 12 in this exemplary pack are held in place by the closed gate 42 as the conveyor belt 36 moves therebelow.

In order to allow more continuous operation of the pack former 16, additional rows of the rolls 12 are allowed to accumulate or backup along the conveyor belt 36 toward the staging land 28. The retainer 54 is operatively joined to the controller 48 for periodically clamping the dwell row, which in this case is the fifth row back from the stop gate 42, so that the previous four rows being held by the gate 42 may be allowed to travel aft as a pack group upon opening of the gate 42.

As shown in more particularity in FIGS. 11 and 12, the retainer 54 preferably includes a pneumatic actuator 54*a* suitably mounted to a carriage 54*b*. The actuator 54*a* is operatively joined to the controller 48 for deploying a plunger against an adjacent roll 12 atop the conveyor belt 36. The actuator 54 is colinearly aligned with the centerlines of the rolls 12 in the row. And, a cooperating clamp plate 54*c* is suitably mounted atop the front guide 38 in the plane of the centerline axes of the rolls 12. When the actuator 54*a* is deployed, the plunger thereof effects a lateral clamping force in the plane of the row cores clamping the several rolls 12 of the dwell row in-line between the actuator 54*a* and the clamp plate 54*c*. In this way, the dwell row remains stationary even as the conveyor belt 36 moves therebelow. The stop gate 42 may then be suitably opened for releasing the pack of rolls 12 while the dwell row is held in place.

In order to coordinate operation of the pack former 16 during operation, a plurality of conventional photo-optical proximity sensors may be used, and all suitably operatively joined to the controller 48. As shown in FIGS. 3 and 7, for example, a first or staging sensor 56*a* is suitably mounted to the back guide 40 at the staging land 28 for detecting the presence of the complete row of the rolls 12 on the staging land 28 to deploy the platen 32. In this regard, the first sensor 56*a* is disposed at the back guide 40, and the brush 30 is preferably inclined to converge from the forward guide 38 toward the back guide 40 above the staging land 28 so that successive ones of the rolls 12 are pushed in turn against the brush 30 until the staging land 28 is filled therewith and detected by the first sensor 56*a*. By sloping the brush 30, increasing resistance is provided as the rolls 12 travel toward the back guide 40, which prevents a roll 12 from occupying the last spot adjacent the first sensor 56*a* until every other spot atop the staging land 28 is filled. In this way, the platen 32 will not prematurely deploy until a full row accumulates atop the staging land 28.

As illustrated in FIGS. 3 and 10, a second or gate sensor 56*b* is disposed at the trailing edge of the packing zone 44 adjoining the stop gate 42 for detecting absence of the rows of rolls 12 in the packing zone 44 to close the gate 42. Once the gate 42 is opened to allow the pack of rolls 12 to be transported by the conveyor 36, the gate 42 should not close until all of the pack rows have passed. The gate sensor 56*b* detects the presence, and absence, of the rolls 12 as they are transported atop the belt 36. As soon as the last row or rolls 12 is transported past the open gate 42, the gate sensor 56*b* detects the absence of a roll which signals the controller 48 to close the gate 42 for the next pack formation.

Also shown in FIGS. 3 and 10, is a third or retainer sensor 56*c* disposed at the packing zone leading edge adjacent the retainer 54 for detecting the presence of the dwell row thereat to actuate the retainer 54 to temporarily retain the dwell row atop the conveyor belt 36, and to simultaneously open the stop gate 42 to allow the pack to leave the packing zone 44. With the gate 42 closed, rows of the rolls 12 accumulate therebehind until the dwell row accumulates at the retainer 54 within proximity of the retainer sensor 56*c*. The controller 48 then actuates the retainer actuator 54*a* to hold the dwell row so that the gate 42 may be opened and allow the configured pack to leave the packing zone 44. The gate 42 is then closed, and the dwell row is released for allowing accumulation of the next pack behind the closed stop gate 42.

As shown in FIGS. 3 and 10, the conveyor belt 36 may have any suitable length for allowing backup or a back log of the rows or rolls 12 to accumulate forward of the retainer 54. Accordingly, a fourth or backup sensor 56*d* is preferably disposed between the packing zone 44 and the staging land 28 to detect a suitable backup of the rolls 12 on the conveyor belt 36 to prevent deployment of the platen 32 until the backup is reduced aft of the sensor 56*d*.

The available length of the conveyor belt 36 illustrated in FIG. 10 allows for a suitable variation in the pack depth D, and back log of the rolls 12 forward of the retainer 54. In the preferred embodiment illustrated in FIG. 10, the retainer carriage 54*b* and cooperating clamp plate 54*c* are mounted atop a pair of stationary rails 54*d* so that the longitudinal position of the retainer 54 may be readily adjusted relative to the stop gate 42 to set the pack depth D. By sliding the retainer 54 closer to the stop gate 42, the depth of the pack is correspondingly reduced, while sliding the retainer 54 away from the gate 42 correspondingly increases the pack depth D. In this way, the pack depth D of one or more rows of the rolls 12 may be readily set up to the available space on the conveyor belt 36.

Figure 13:
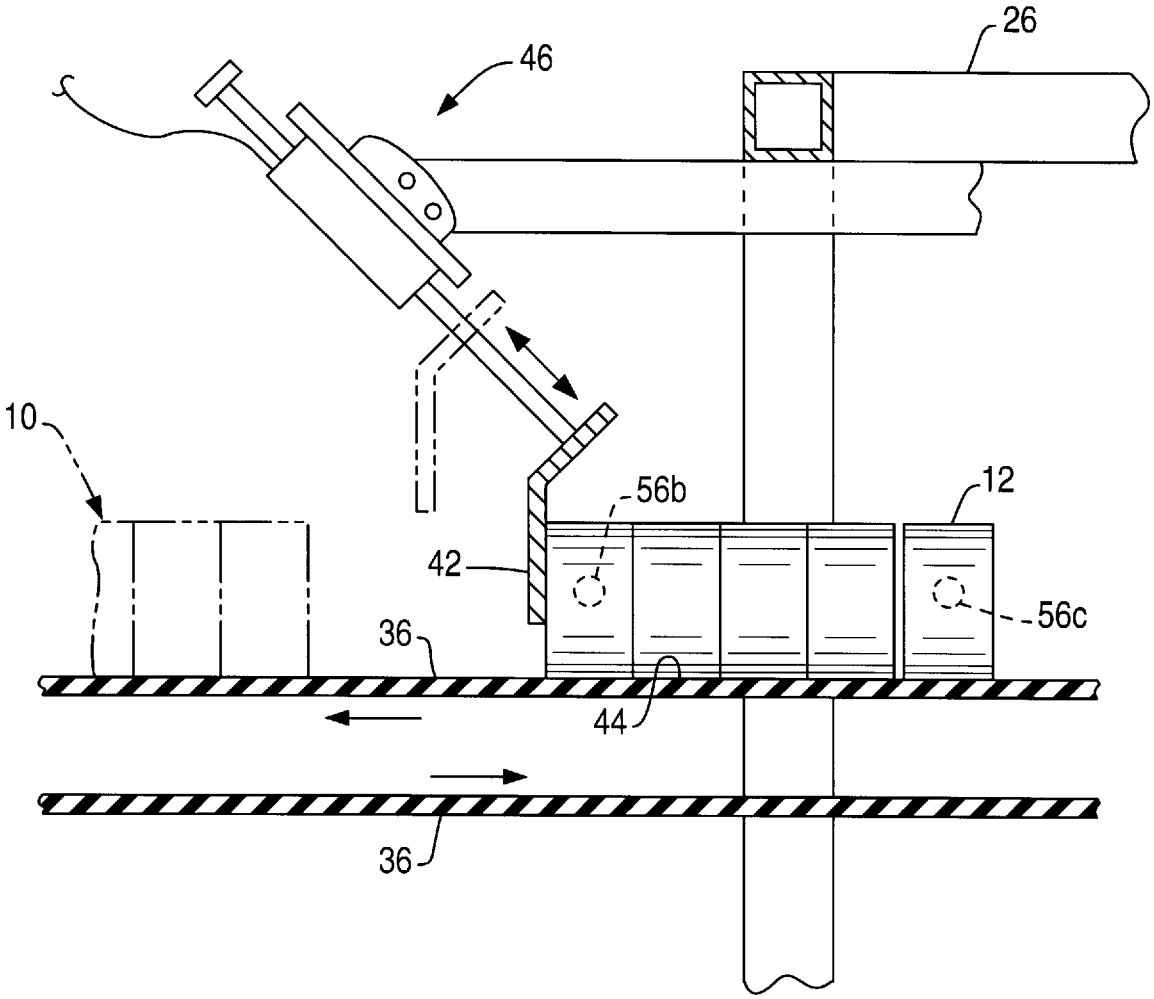
FIG. 13 is an elevational, partly sectional view of a stop gate illustrated in FIG. 10 and taken generally along line 13—13.

As illustrated more clearly in FIG. 13, the stop gate 42 is preferably suspended from the main frame 26 vertically above the conveyor belt 36. The gate actuator 46 is operatively joined to the gate 42 and the controller 48 to periodically lift open the gate 42 as shown in phantom line, and drop close the gate 42, as shown in solid line, to release the packs 10 in sequence from the packing zone 44. The stop gate 42 is preferably inclined upwardly aft from the conveyor belt 36 at the trailing edge of the packing zone 44, and is configured to lift the gate 42 away from the pack 10 being carried by the conveyor belt 36 to separate the gate 42 from the adjoining row, or leading edge, of the released, and moving, pack without contact therewith for preventing undesirable tipping of the rolls 12.

As shown in FIG. 10, the gate 42 is restrained from pivoting by a pair of laterally spaced apart guide rails fixedly joined thereto and slidingly attached to a portion of the main frame 26. The gate actuator 46 may be a suitable pneumatic actuator operatively joined to the controller 48 for lifting and dropping the gate 42 upon command.

As indicated above, the pack depth D is simply adjusted by adjusting the longitudinal position of the retainer 54 relative to the stop gate 42. And, the pack width W is simply adjusted by interchanging the platen 32 with a platen having a different width, such as the smaller second platen 32B illustrated in FIG. 14 in the reconfigured pack former 16. In the FIG. 10 embodiment of the invention, the pack former 16 is configured for grouping packs in a 5×4 width and depth. In the FIG. 14 embodiment, the pack former 16 has been suitably adjusted for grouping the packs in a 2×2 width and depth configuration. The pack depth D is simply reset by translating the retainer 54 along the rail 54*d* closer to the stop gate 42 for marshaling the rolls 12 in only a two-deep configuration. The narrower platen 32B is exchanged for the wider platen 32 on the plate carriage 34*a* for pushing from the staging land 28 only a pair of the rolls 12 for a two-unit pack width W.

However, in order to suitably guide the two-roll rows along the conveyor belt 36, the front and back guides 38, 40 are suitably adjusted in lateral width to confine travel of the narrower rows along the conveyor belt 36. In the exemplary embodiment illustrated in FIG. 14, the front guide 38 is preferably stationary and suitably fixedly suspended from an upper portion of the main frame 26 atop the conveyor belt 36. The back guide 40 is suitably joined to the subframe of the conveyor belt 36. The pull roller 52 illustrated in FIG. 10 is also suitably fixedly joined to the subframe of the conveyor belt 36.

Figure 14:
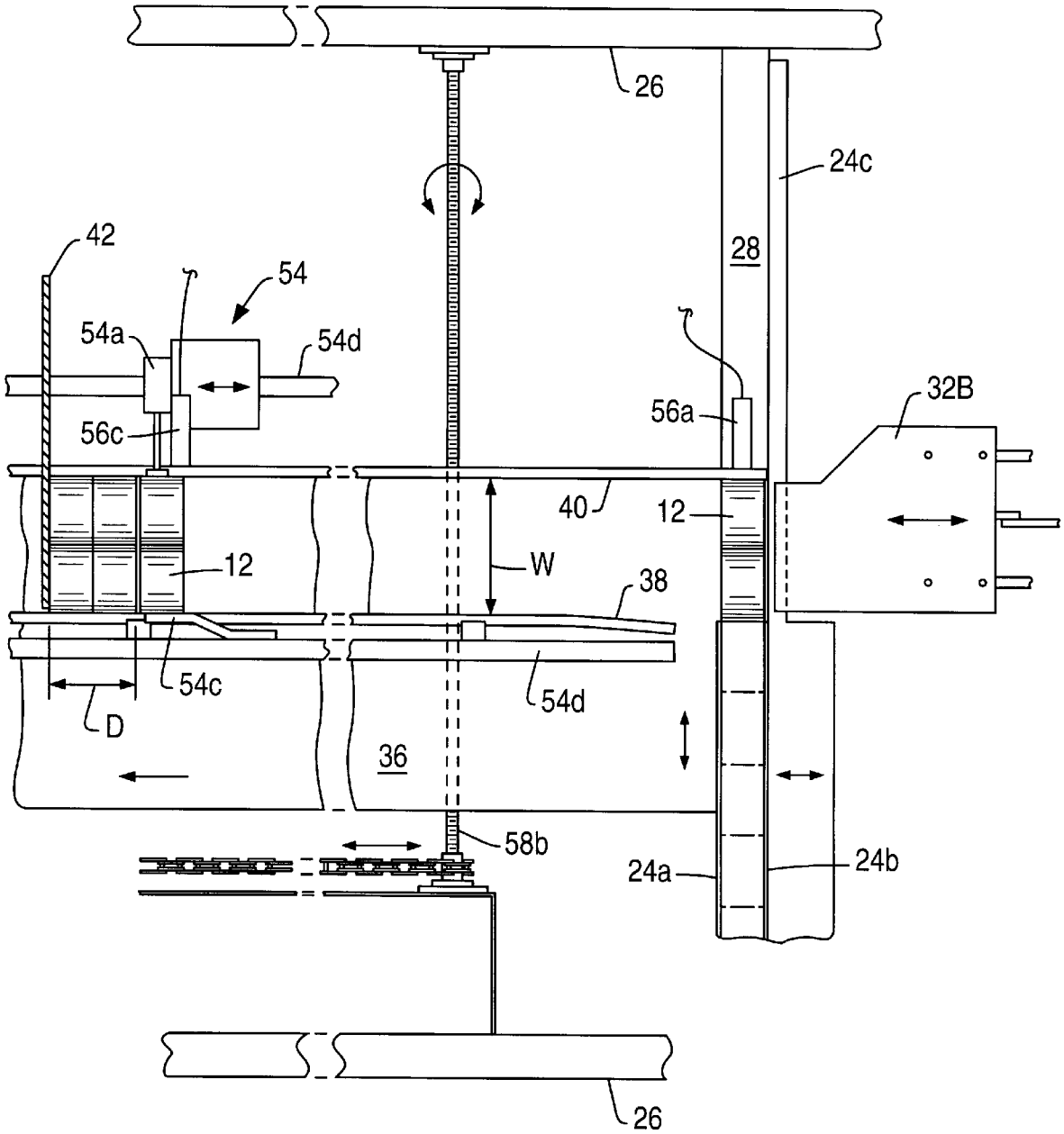
FIG. 14 is a partly sectional plan view of a portion of the pack former illustrated in FIG. 3 reconfigured for forming packs in a 2×2 pack configuration.

The conveyor subframe itself is suitably mounted to the main frame 26 for being laterally adjustable in position relative to the front guide 38, staging land 28, and platen 32 to match the pack width W. As shown in FIGS. 10 and 14, the conveyor subframe is preferably mounted on a pair of longitudinally spaced apart threaded rods or screws 58*a,b,* which rods mount the conveyor belt to the main frame 26. A suitable chain drive 58*c* is operatively joined between the two rods 58*a,b,* and a simple rotating handle or wheel 58*d* is attached to one of the rods 58*a,b.* As the handle 58*d* is manually rotated, both the threaded rods 58*a,b* are rotated in unison, and extend through threaded bosses within the subframe of the conveyor belt 36 so that the conveyor belt 36 is laterally translated relative to the main frame 26. In this way, the entire conveyor belt 36 may be translated toward the stationary front guide 38 as illustrated in FIG. 14 reducing the lateral spacing between the front and back guides 38, 40 to match the desired pack width W. The unused portion of the conveyor belt 36 is located outside the front guide 38, with the narrower spacing guides 38, 40 providing sufficient width for the selected pack configuration.

The Shanklin shrink wrapper 50 disclosed above was modified for the present invention by extending the length of the conveyor belt 36. The second rod 58*b* and chain drive were added to synchronize the lateral adjustable movement of the longer belt 36. And, the front and back guides 38,40 were reconfigured as cylindrical rods mounted to specifically guide the lower portion of the perimeters of the rolls 12 for reducing or eliminating undesirable roll skewing during transport.

The individual rolls 12 of the desired packs 10 may now be readily configured in integer multiples for separately setting the pack width W and pack depth D individually for one or more rolls 12. Various pack configurations from 1×1 upwardly to about 5×7 may be obtained within the available space of the pack former 16. The number of rolls 12 in the pack width W and pack depth D may be independently varied to correspondingly vary the resulting pack configuration as desired, with numerous configurations now being possible. Since the pack former 16 is configured for transporting the individual rolls 12 in direct contact with adjacent rolls 12 in both the width W and depth D directions, no intervening lane or row dividers are required which could create jamming problems or reduce speed of operation.

The pack former 16, illustrated for example in FIG. 3, therefore provides an improved method of forming the pack 10 of rolls 12 in integer width W and integer depth D configurations. The method includes initially staging the rolls 12 in a contiguous row of laterally adjoining perimeters 12*d* in the staging chute 24 and staging land 28. One or more of the staged rolls 12 is then periodically conveyed to the packing zone 44 to define the pack width W. One or more of the conveyed rolls 12 are periodically marshaled at the packing zone 44 to define the pack depth D along the centerline axis of the rolls 12. The marshaled rolls 12 are then periodically conveyed as the packs 10 having a selected width W and depth D.

Preferably a plurality of the staged rolls 12 from the staging land 28 are conveyed to the packing zone 44 in a corresponding row having the desired pack width W. A plurality of the conveyed rows are then marshaled at the packing zone 44 to define the desired pack 10. The number of the staged rolls 12 atop the staging land 28 may be adjusted to adjust the pack width W. And, the number of the marshaled rows of the rolls 12 in the packing zone 44 may be adjusted to adjust the pack depth D.

It is preferable to use the feed pounder conveyor 18 for initially ensuring substantially flush alignment of the cores 12*a* within the rolls 12 to reduce the likelihood of interference between adjoining rolls 12 which could cause jamming or tipping of the rolls 12 during transport. The spiral feed chute 20 then allows the individual rolls 12 to be rotated in sequence from their initial vertical orientation to the desired horizontal orientation to elevate the perimeters 12*d* thereof for transport through the various stages of the pack former 16.

In this regard, the clamp plate 54*c* illustrated in FIGS. 10–12 is preferably aligned with the centerline plane of the individuals rolls 12 above the front guide 38 so that actuation of the retainer 54 clamps together the dwell row of rolls 12 slightly displacing this row relative to the last row of the marshaled pack. In this way, the corresponding cores of these two rows are slightly offset from each other and reduce the likelihood of interference therebetween for allowing unrestrained ejection of the marshaled pack from the packing zone 44 upon opening of the stop gate 42.

The resulting pack former 16 described above has substantial flexibility in forming various pack configurations of differing pack width W and pack depth D at substantial packaging speeds greater than those achievable by prior art pack formers such as the one described above in the Background Section. The pack former 16 also has the ability to transfer very narrow width (d) rolls 12 without tipping over as they are transported through the various stages of the pack former 16. The pack former 16 is substantially simple to set up and reconfigure in changing pack width and depth, and correspondingly has improved reliability of operation with reduced likelihood of interference and jamming between the rolls and the components of the pack former.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A pack former for grouping a plurality of rolls in a pack, comprising:

a frame;

a conveyor belt mounted to said frame, and having a leading edge;

a staging land for initially receiving said rolls in a row, and adjoining said belt leading edge for delivering said row thereto;

a platen adjoining said staging land, and sized in width to engage said row in an integer multiple of said rolls to set a width for said pack;

an actuator for reciprocating said platen over said staging land to push said row onto said conveyor belt;

a front guide disposed atop said conveyor belt and extending from said staging land;

a back guide disposed atop said conveyor belt and extending from said staging land, and spaced laterally from said front guide to correspond with said pack width;

a stop gate disposed atop said conveyor belt, and spaced from said belt leading edge to define a packing zone for collecting a plurality of said rows being transported by said conveyor belt from said staging land, said packing zone being sized in length to set a depth in integer multiples of said rolls;

an actuator for reciprocating said gate between open and closed positions; and a controller operatively joined to said platen and gate actuators to periodically close said gate and deploy said platen to marshal said rolls in said packing zone to define a specific configuration of said width and depth of said pack.

2. A pack former according to claim 1 further comprising:

a retainer disposed at a leading edge of said packing zone for periodically retaining a dwell one of said rows to allow said gate to open, and said pack to leave said packing zone.

3. A pack former according to claim 2 wherein said back guide is adjustable to vary said pack width in integer multiples of said rolls.

4. A pack former according to claim 3 further comprising:

a first sensor disposed at said staging land, and operatively joined to said controller for detecting presence of said row on said staging land to deploy said platen; and a second sensor disposed at a trailing edge of said packing zone adjoining said gate, and operatively joined to said controller for detecting absence of said rows in said packing zone to close said gate; and a third sensor disposed at said packing zone leading edge adjacent said retainer, and operatively joined to said controller for detecting presence of said dwell row thereat to actuate said retainer to temporarily retain said dwell row, and to open said gate to allow said pack to leave said packing zone.

5. A pack former according to claim 4 further comprising a brush disposed above said staging land for resiliently engaging said rolls upon receipt atop said staging land.

6. A pack former according to claim 5 wherein:

said first sensor is disposed at said back guide; and said brush converges from said front guide toward said back guide above said staging land so that successive ones of said rolls are pushed in turn against said brush until said staging land is filled therewith and detected by said first sensor.

7. A pack former according to claim 4 for comprising a staging chute extending to said staging land for transporting said rolls sequentially thereto.

8. A pack former according to claim 7 wherein said staging chute includes a pair of sidewalls adjustable in spacing for accommodating different width rolls.

9. A pack former according to claim 7 further comprising a feed chute extending to said staging chute for rotating orientation of said rolls prior to entering said staging chute.

10. A pack former according to claim 9 wherein:

each of said rolls has two flat sides spaced apart at a depth, and a cylindrical perimeter having a diameter height, and has a vertical orientation resting on one of said flat sides, and a horizontal orientation resting on said perimeter; and said feed chute is configured to rotate said rolls from said vertical to horizontal orientations to feed horizontal rolls into said staging chute for staging atop said staging land.

11. A pack former according to claim 10 further comprising a guide bar fixedly joined atop said feed chute, and adjustable in height for guiding said rolls therethrough.

12. A pack former according to claim 4 wherein said platen actuator comprises:

a carriage mounted to said frame for transporting said platen thereatop, with said platen being interchangeable thereon to vary said pack width; and a drive operatively joined to said carriage and said controller to periodically reciprocate said platen to push a plurality of said rows in sequence from said staging land onto said conveyor belt.

13. A pack former according to claim 4 further comprising:

a pull roller spaced atop said belt adjacent said staging land to match a height of said rolls; and a drive for rotating said pull roller at a surface speed substantially equal to a surface speed of said conveyor belt so that said pull roller captures said rows deployed from said staging land to prevent tipping thereof.

14. A pack former according to claim 4 wherein:

said front guide is stationary;

said back guide is joined to a subframe of said conveyor belt; and said conveyor belt subframe is mounted to said frame for being laterally adjustable in position relative to said front guide, staging land, and platen to match said pack width.

15. A pack former according to claim 4 wherein:

said stop gate is suspended from said frame vertically above said conveyor belt; and said gate actuator is operatively joined to said gate to periodically lift open said gate and drop close said gate to release said packs in sequence from said packing zone.

16. A pack former according to claim 15 wherein:

said stop gate inclined upwardly aft from said conveyor belt; and said gate actuator is configured to lift said gate away from said pack being carried by said conveyor belt.

17. A pack former according to claim 16 further comprising:

a brush disposed above said staging land for resiliently engaging said rolls upon receipt atop said staging land;

said first sensor being disposed at said back guide above said staging land; and said brush converging from said front guide toward said back guide above said staging land so that successive ones of said rolls are pushed in turn against said brush until said staging land is filled therewith and detected by said first sensor.

18. A pack former according to claim 17 further comprising:

a staging chute extending to said staging land for transporting said rolls sequentially thereto; and a feed chute extending to said staging chute for rotating orientation of said rolls prior to entering said staging chute.

19. A pack former according to claim 18 wherein:

said front guide is stationary;

said back guide is joined to a subframe of said conveyor belt; and said conveyor belt subframe is mounted to said frame for being laterally adjustable in position relative to said front guide, staging land, and platen to match said pack width.

20. A pack former according to claim 4 in combination with a shrink wrapper adjoining said conveyor belt aft of said gate for receiving said pack to shrink wrap a wrapping thereover.

* * * * *